US011708748B2

(12) United States Patent
Li et al.

(10) Patent No.: US 11,708,748 B2
(45) Date of Patent: Jul. 25, 2023

(54) DEVICE AND METHOD FOR GAS-WATER-SAND SEPARATION AND MEASUREMENT IN EXPERIMENT OF NATURAL GAS HYDRATE EXPLOITATION

(71) Applicant: GUANGZHOU INSTITUTE OF ENERGY CONVERSION, CHINESE ACADEMY OF SCIENCES, Guangzhou (CN)

(72) Inventors: Xiaosen Li, Guangzhou (CN); Zhaoyang Chen, Guangzhou (CN); Yi Wang, Guangzhou (CN); Zhiming Xia, Guangzhou (CN); Yu Zhang, Guangzhou (CN); Gang Li, Guangzhou (CN)

(73) Assignee: GUANGZHOU INSTITUTE OF ENERGY CONVERSION, CHINESE ACADEMY OF SCIENCES, Guangzhou (CN)

( * ) Notice: Subject to any disclaimer, the term of this patent is extended or adjusted under 35 U.S.C. 154(b) by 329 days.

(21) Appl. No.: 17/257,313

(22) PCT Filed: Sep. 8, 2020

(86) PCT No.: PCT/CN2020/114099
§ 371 (c)(1),
(2) Date: Dec. 31, 2020

(87) PCT Pub. No.: WO2021/159699
PCT Pub. Date: Aug. 19, 2021

(65) Prior Publication Data

US 2022/0298892 A1 Sep. 22, 2022

(30) Foreign Application Priority Data

Aug. 6, 2020 (CN) ..... 202010784600.7

(51) Int. Cl.
*E21B 41/00* (2006.01)
*E21B 43/34* (2006.01)
(Continued)

(52) U.S. Cl.
CPC ..... *E21B 41/0099* (2020.05); *E21B 43/084* (2013.01); *E21B 43/35* (2020.05); *E21B 47/06* (2013.01); *E21B 2200/20* (2020.05)

(58) Field of Classification Search
CPC .... E21B 41/0099; E21B 43/084; E21B 43/35; E21B 47/06; E21B 2200/20; E21B 43/00;
(Continued)

(56) References Cited

FOREIGN PATENT DOCUMENTS

CN 102052065 A * 5/2011
CN 102052065 A 5/2011
(Continued)

*Primary Examiner* — Raul J Rios Russo
*Assistant Examiner* — Dilara Sultana
(74) *Attorney, Agent, or Firm* — Bayramoglu Law Offices LLC

(57) ABSTRACT

A device and a method for gas-water-sand separation and measurement during a simulated exploitation of natural gas hydrates are disclosed. The device includes a natural gas hydrate formation and dissociation system and a filtering unit. The natural gas hydrate formation and dissociation system includes a compressed air pump, a reactor, and a water-bath temperature regulating unit. The filtering unit includes a kettle body, wherein an inlet end of the kettle body is connected to the sand-control liner zone, an outlet end of the kettle body is connected to a water-collecting container, and a plurality of filtering layers are disposed inside the kettle body from the inlet end to the outlet end. The method is conducted using the device. The device and the method realize the gas-water-sand separation and measurement of produced gas-water-sand mixture during a
(Continued)

simulative exploitation process, allowing for a direct inspection on a sand production and sand control.

8 Claims, 2 Drawing Sheets

(51) Int. Cl.
*E21B 43/08* (2006.01)
*E21B 47/06* (2012.01)

(58) Field of Classification Search
CPC ..... E21B 43/01; E21B 43/08; E21B 43/16; E21B 43/24; E21B 43/34
See application file for complete search history.

(56) References Cited

FOREIGN PATENT DOCUMENTS

| | | | | | |
|---|---|---|---|---|---|
| CN | 102109513 | A | * | 6/2011 | |
| CN | 102109513 | A | | 6/2011 | |
| CN | 102305052 | A | | 1/2012 | |
| CN | 105372392 | A | * | 3/2016 | ..... G01N 33/00 |
| CN | 107121359 | A | * | 9/2017 | ..... G01N 11/00 |
| CN | 107860569 | A | * | 3/2018 | ..... G01M 13/00 |
| CN | 107860569 | A | | 3/2018 | |
| CN | 109707377 | A | * | 5/2019 | |
| RU | 2027001 | C1 | | 1/1995 | |
| WO | 2017024538 | A1 | | 2/2017 | |

* cited by examiner

DEVICE AND METHOD FOR GAS-WATER-SAND SEPARATION AND MEASUREMENT IN EXPERIMENT OF NATURAL GAS HYDRATE EXPLOITATION

CROSS REFERENCE TO THE RELATED APPLICATIONS

This application is the national stage entry of International Application No. PCT/CN2020/114099, filed on Sep. 8, 2020, which is based upon and claims priority to Chinese Patent Application No. 202010784600.7, filed on Aug. 6, 2020, the entire contents of which are incorporated herein by reference.

TECHNICAL FIELD

The present invention relates to sand production and sand control test during natural gas hydrate exploitations, and particularly relates to device and method for gas-water-sand separation and measurement in an experiment of natural gas hydrate exploitation.

BACKGROUND

Natural gas hydrates are promising clean energy source. Sand production is one issue need to be addressed during trials of hydrate production, but there are few studies focusing on the sand production issue during simulation of hydrate production, and the challenges of how to measure sand production and how to realize gas-water-sand separation during simulation of hydrate production have not been resolved. Accordingly, separation and measurement of the gas-water-sand mixture during the simulation have been key factors in the studies on sand production and sand control during simulation of hydrate production.

At present, existing methods, for measuring sand production and gas-water-sand separation during simulation of hydrate production, do not allow the real-time measurement and observation, or the separation and measurement for a gas-liquid-solid three-phase flow or a liquid-solid, gas-solid or gas-liquid two-phase flow.

SUMMARY

In view of the above defects of the prior art, the present invention provides experimental device and method for gas-water-sand separation and measurement during a simulated exploitation of natural gas hydrates. The device and method allow separating and measuring the gas-water-sand mixture produced during the simulative exploitation to intuitively reflect the sand production and sand control, and enable the separation and measurement for a gas-liquid-solid three-phase flow or a liquid-solid, gas-solid or gas-liquid two-phase flow, which is useful for analyzing the patterns and features of gas-water-sand production during the simulation of hydrate production.

In order to realize the above object, the technical solution of the present invention involves:

One aspect of the invention is a device for separation and measurement in a simulative exploitation of natural gas hydrates, comprising a natural gas hydrate formation and dissociation system and a filtering unit, wherein, the natural gas hydrate formation and dissociation system comprises a compressed air pump, a reactor, and a water-bath temperature regulating unit; a piston and a separating plate is disposed inside an inner chamber of the reactor along an axial direction; a confined space between the piston and one end of the inner chamber is defined to be a first zone (an axial-pressure air chamber), and the compressed air pump is configured to introduce air into the axial-pressure air chamber to drive the piston towards the separating plate; a confined space between the piston and the separating plate is defined to be a second zone (a hydrate formation and dissociation zone), wherein the hydrate formation and dissociation zone is connected to a methane gas pressurizing and introducing unit and a constant-flow pump for introducing water; a confined space between the separating plate and the other end of the inner chamber is defined to include a third zone (a sand-control liner zone) and a fourth zone (a wellbore exploitation zone); the axial-pressure air chamber, the hydrate formation and dissociation zone, the sand-control liner zone, the wellbore exploitation zone, and the filtering unit are respectively provided with electronic units for collecting physical properties;

the filtering unit comprises a kettle body, wherein an inlet end of the kettle body is connected to the sand-control liner zone, and an outlet end of the kettle body is connected to a water-collecting container; a plurality of filtering layers are disposed inside the kettle body from the inlet end to the outlet end, wherein the plurality of filtering layers have successively reduced diameters and successively reduced filtered particle sizes (i.e., diameters of the plurality of filtering layers reduce layer by layer, and filtered particle sizes of the plurality of filtering layers reduce layer by layer); an output end of the filtering layers is connected to a gas recovering unit, and a sight glass is provided on a wall of the kettle body and above an input end of the filtering layers; a camera and a lamp are provided outside the sight glass, wherein the camera is configured to monitor a mixture (such as a gas-water-sand mixture, a water-sand mixture, a gas-water mixture, or a gas-sand mixture) flowing into the kettle body through the sight glass; a support for securing and supporting the kettle body is disposed at an bottom end of the kettle body, wherein a vibrating unit is provided in the support, and the vibrating unit is configured to produce a vibration for improving sand separation and promoting fluid flow inside the kettle body.

The device as described above is further characterized in that, the filtering layers comprises a first screening layer, a second screening layer, and a third screening layer, with successively reduced filtered particle sizes (i.e., a coarse screening layer, an intermediate screening layer, and a fine screening layer; the filtered particle sizes may be determined depending on actual needs); each of the coarse screening layer, the intermediate screening layer, and the fine screening layer comprises an annular support and a screen mesh attached to the annular support, a plurality of pressure measuring sites are defined on the annular support, and each of the pressure measuring sites is enclosed by a ring, wherein the ring is configured to confine the pressure measuring site inside an area of the ring; a plurality of thin-film pressure sensors relative to the pressure measuring sites are provided on the kettle body, wherein the thin-film pressure sensors are configured to measure a total weight of the screen mesh, the annular support, and filtered sands.

The device as described above is further characterized in that, a first pressure sensor (a pre-screening pressure sensor) and a first temperature sensor (a pre-screening temperature sensor) are disposed above the coarse screening layer, and a water baffle is disposed below the fine screening layer, wherein the water baffle is disposed obliquely at an angle inside the kettle body; a second pressure sensor (a post-screening pressure sensor) is disposed below a higher side of the water baffle, such that a degree of clogging of the screen mesh and a degree of airflow stability can be determined by combining the post-screening pressure sensor with the pre-screening pressure sensor and the thin-film pressure sensors; a fourth screening layer (an ultra-fine screen mesh) is disposed at a semi-circular opening formed at a lower side of the water baffle, wherein the ultra-fine screen mesh has a filtered particle size lower than that of the fine screening layer; a second temperature sensor (a post-screening temperature sensor) is disposed between the ultra-fine screen mesh and the fine screening layer, wherein the pre-screening temperature sensor and the post-screening temperature sensor are configured to determine a temperature change of the mixture after passing through the filtering layers.

The device as described above is further characterized in that, a detachable upper lid is attached to an upper end of the kettle body, and a detachable lower lid is attached to a lower end of the kettle body.

The device as described above is further characterized in that, the detachable lower lid has a slope inclined to a water outlet, the water outlet is connected to the water-collecting container via a first pipe, and the first pipe is provided with a water valve; the water-collecting container is disposed on a weighing device, and the water-collecting container is provided with a gas discharge valve; the gas recovering unit is connected to a position below the higher end of the water baffle via a second pipe, and the second pipe is provided with a gas valve and a gas flowmeter.

The device as described above is further characterized in that:

the axial-pressure air chamber is provided with a third pressure sensor (an axial pressure sensor);

the hydrate formation and dissociation zone is provided with a piston stop (a component that stops travel of the piston), the methane gas pressurizing and introducing unit is provided with a gas-introducing valve, and the constant-flow pump for introducing water is provided with a water-introducing valve; a plurality of temperature sensors are disposed inside the hydrate formation and dissociation zone and along an axial direction of the hydrate formation and dissociation zone, and a fourth pressure sensor (a kettle pressure sensor) is disposed on an inner wall of the hydrate formation and dissociation zone; the hydrate formation and dissociation zone is further provided with a hydrate zone inlet;

a first screen mesh, a filling material (such as gravel), and a second screen mesh are sequentially disposed in the sand-control liner zone, and a third temperature sensor (a liner zone temperature sensor) is disposed in the sand-control liner zone; the sand-control liner zone is further provided with a liner zone inlet; and a separating plate control unit is provided, and the separating plate control unit is configured to control the separating plate to open or close.

The device as described above is further characterized in that, a fourth temperature sensor (a wellbore temperature sensor) and a fifth pressure sensor (a wellbore pressure sensor) are disposed in the wellbore exploitation zone; the wellbore exploitation zone is connected to a particle size analyzer for analyzing particle sizes of produced sands; a wellbore inlet is provided and configured to introduce a simulative wellbore fluid; a detachable lid is attached to one end of the reactor at the wellbore exploitation zone.

The device as described above is further characterized in that, the wellbore exploitation zone is provided with a wellbore outlet, wherein the well bore outlet is connected to an opening of the detachable upper lid through a sand production analysis section and a ball valve.

The device as described above is further characterized in that, it further comprises a sensor data collector and a host computer, wherein a data analyzing software is installed on the host computer, the sensor data collector is signally connected to the sensors in the natural gas hydrate formation and dissociation system and the filtering unit, and configured to collect and analyze data in real time during an experiment.

Another aspect of the invention is a method for separation and measurement in a simulative exploitation of natural gas hydrates, using one of the devices as described above, and comprising the following steps:

filling the reactor with a porous medium through one end of the reactor, and closing the separating plate;

checking gas-tightness of the reactor so as to allow the electronic units to operate normally;

introducing predetermined amounts of water and methane gas sequentially into the hydrate formation and dissociation zone, regulating a temperature in the reactor using the water-bath temperature regulating unit, introducing air with the compressed air pump to push the piston to maintain a pressure in the hydrate formation and dissociation zone stable and thereby natural gas hydrates are formed in the hydrate formation and dissociation zone;

when the pressure in the hydrate formation and dissociation zone stays unchanged or reaches a predetermined value, conducting a simulation of a natural gas hydrate exploitation process by the depressurized method or the thermal stimulation method; the mixture produced during the natural gas hydrate exploitation process enters the kettle body and passes through the plurality of filtering layers, wherein sands will be filtered out and collected, gas will enter the gas recovering unit, and water will enter the water-collecting container; when it is a three-phase separation, turning on the gas recovering unit and the water-collecting container; when it is a solid-liquid separation, turning on the water-collecting container; when it is a gas-liquid separation, turning on the gas recovering unit and the water-collecting container; when it is a gas-solid separation, turning on the vibrating unit and the gas recovering unit.

Compared with the prior art, the present invention has the following beneficial effects:

The device enables dynamic monitoring of the produced gas-water-sand mixture during the simulative formation, dissociation, and exploitation of hydrates; the device enables analysis on the changes in parameters such as the gas/water/sand production and the pressure in different stages of an experiment of hydrate exploitation, sand production, and sand control; the device enables analysis on the changes in pressure and the patterns of gas/liquid/solid production in each stage of a simulative exploitation of natural gas hydrates. By adjusting the simulative exploitation protocol, it is possible to obtain feedback in the gas/water/sand production, and thereby evaluate and optimize the sand production and sand control performance, facilitating the analysis and calculation of the varying patterns and features of gas/water/sand production, and providing supports for establishing sand control schemes for actual hydrate exploitations.

(1) The device enables the separation and measurement of a solid-liquid-gas three-phase flow depending on the gas/water/sand production in a simulative exploitation of natural gas hydrates. The device enables the observation, separation and measurement of a liquid-solid, gas-solid, or gas-liquid two-phase flow. The device can provide practical verification for simulative sand production and sand control depending on the separation and measurement conditions, facilitating the analysis and calculation of the varying patterns and features of gas/water/sand production, and providing supports for establishing sand control schemes for actual hydrate exploitations.

(2) The device is capable of measuring the flow of produced gas, weighing the sands of different particle sizes, and measuring the volume of produced water in real time. The device also comprises a vibrating unit for preventing clogging, and extended sensor interface for real-time monitoring of pressure and temperature in the kettle. A key feature is the separation and measurement of produced sands of different size, wherein each screening layer is provided with four thin-film sensors for measuring the weight, and the sand production site distribution and sand size distribution can be obtained from a weight curve subsequently.

(3) The device has the advantages of simple structure, high pressure resistance, convenient disassembly and assembly, and visualized and real-time observation of the gas-water-sand flow.

Reference signs: 1—gas/water/sand production pipeline; 2—ball valve; 3—curved pipe; 4—detachable upper lid; 5—transparent sight glass; 6—lamp; 7—rear thin-film pressure sensor (coarse screening layer); 8—combination of coarse screen mesh and annular support; 9—camera; 10—pre-screening temperature sensor; 11—pre-screening pressure sensor; 12—left thin-film pressure sensor (coarse screening layer); 13—front thin-film pressure sensor (coarse screening layer); 14—right thin-film pressure sensor (coarse screening layer); 15—left thin-film pressure sensor (intermediate screening layer); 16—front thin-film pressure sensor (intermediate screening layer); 17—rear thin-film pressure sensor (intermediate screening layer); 18—right thin-film pressure sensor (intermediate screening layer); 19—combination of intermediate screen mesh and annular support; 20—kettle body; 21—left thin-film pressure sensor (fine screening layer); 22—front thin-film pressure sensor (fine screening layer); 23—rear thin-film pressure sensor (fine screening layer); 24—right thin-film pressure sensor (fine screening layer); 25—combination of fine screen mesh and annular support; 26—post-screening temperature sensor; 27—post-screening pressure sensor; 28—water baffle; 29—ultra-fine screen mesh; 30—gas outlet; 31—detachable lower lid; 32—water outlet; 33—support; 34—vibrating unit; 35—cushion; 36—gas valve; 37—gas flowmeter; 38—gas recovering unit; 39—water valve; 40—water-collecting container; 41—gas discharge valve; 42—weighing device; 43—ring; 44—pressure measuring site (force-bearing site); 45—annular support; 46—coarse screen mesh; 47—intermediate screen mesh; 48—fine screen mesh; 49—a circle formed of the cross section of the inner surface of kettle wall; 50—outer wall; 51—compressed air pump; 52—axial pressure sensor; 53—axial-pressure air chamber; 54—water-bath temperature regulating unit; 55—reactor; 56—piston; 57—piston stop; 58—kettle pressure sensor; 59—left temperature sensor; 60—intermediate temperature sensor; 61—gas-introducing valve; 62—methane gas pressurizing and introducing unit; 63—hydrate zone inlet; 64—right temperature sensor; 65—water-introducing valve; 66—constant-flow pump; 67—hydrate formation and dissociation zone; 68—separating plate control unit; 69—separating plate; 70—liner zone temperature sensor; 71—liner zone inlet; 72—sand-control liner zone; 73—wellbore temperature sensor; 74—detachable threaded lid; 75—wellbore inlet; 76—wellbore pressure sensor; 77—wellbore outlet; 78—particle size analyzer; 79—sand production analysis section; 80—sensor data collector; 81—data analyzing software.

DETAILED DESCRIPTION OF THE EMBODIMENTS

The content of the present invention will be further described in detail below with the drawings and specific embodiments.

Figure 1:
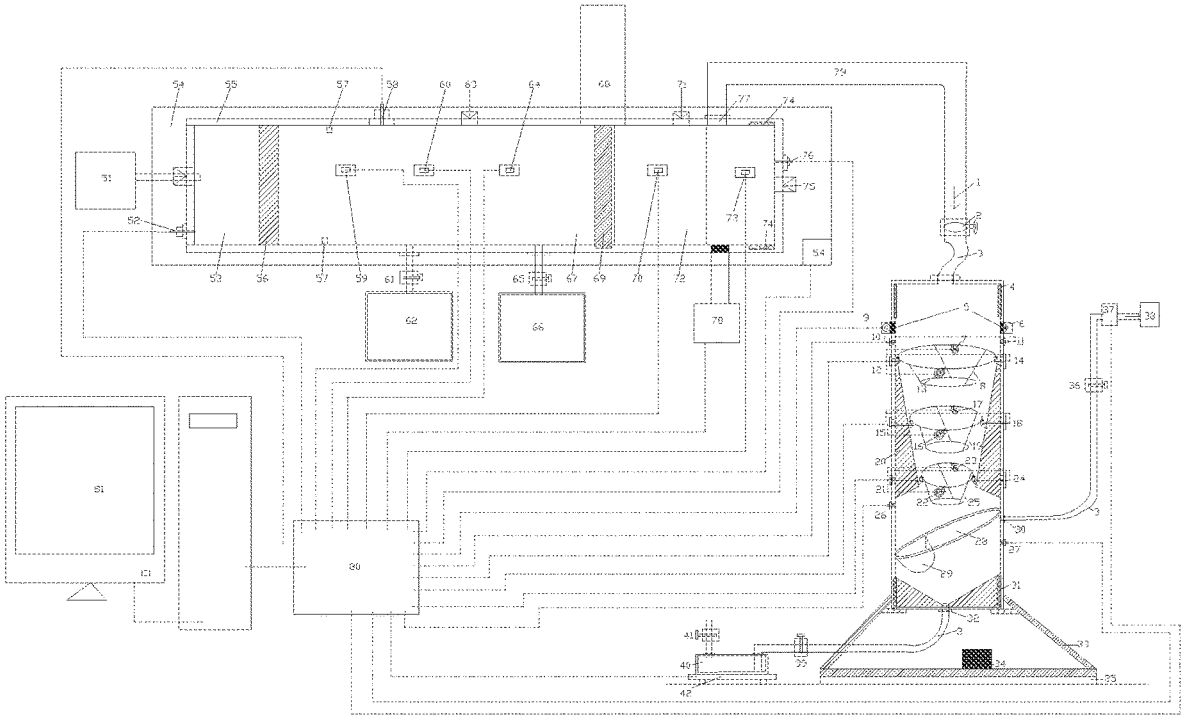
FIG. 1 shows the structure of the device of the present invention.
Figure 2:
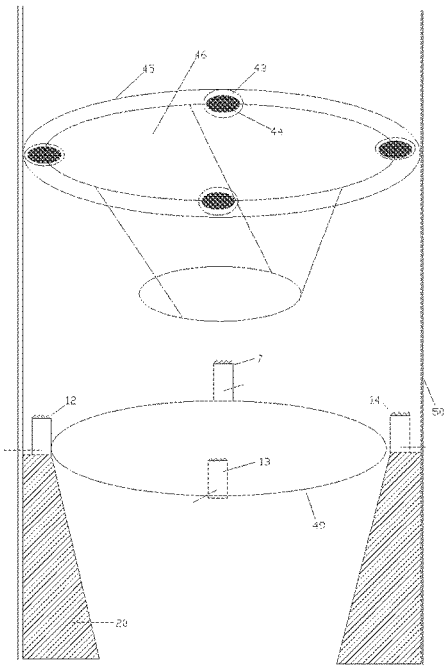
FIG. 2 shows a partial view of the filtering unit of the present invention.
Figure 3:
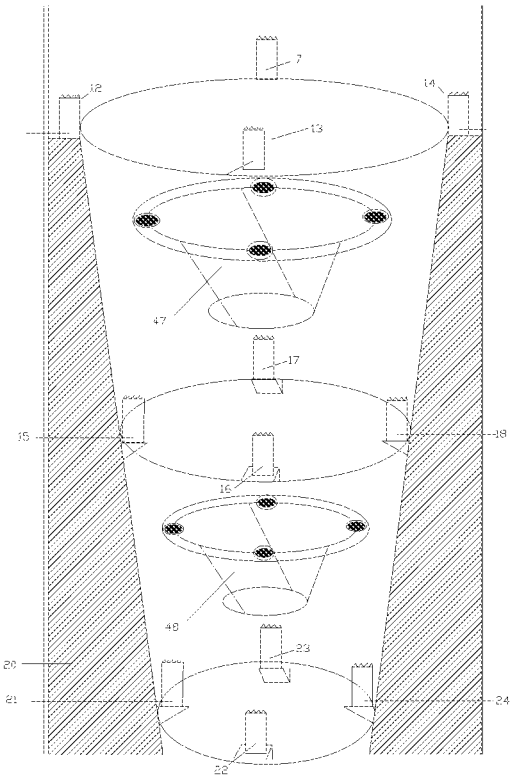
FIG. 3 shows another partial view of the filtering unit of the present invention.

As shown in FIG. 1 to FIG. 3 (in FIG. 3, the screen meshes and annular supports are illustrated to be disposed apart from the sensors for the purpose of demonstration only, which does not represent the actual sizes and positions of the screen meshes and annular supports), the device of the present invention comprises:

a natural gas hydrate formation and dissociation system, consisting of a compressed air pump 51, a reactor 55, a methane gas pressurizing and introducing unit 62, a constant-flow pump 66 for introducing water, a particle size analyzer 78 for analyzing particle sizes of produced sands, a sensor data collector 80, and a data analyzing software 81; and a gas-water-sand inlet pipe, consisting of a gas/water/sand production pipeline 1 for transferring produced gas/water/sand, a ball valve 2, and a curved pipe 3;

a kettle, consisting of a detachable upper lid 4, a transparent sight glass 5, a kettle body 20, a water baffle 28, a detachable lower lid 31, and a support 33;

a coarse screening layer, an intermediate screening layer, and a fine screening layer, respectively consisting of a combination 8 of coarse screen mesh and an annular support, a combination 19 of intermediate screen mesh and an annular support, and a combination 25 of fine screen mesh and an annular support;

a gas outlet pipeline, consisting of a gas outlet 30, a gas valve 36, a gas flowmeter 37; and a water outlet pipeline, consisting of a water outlet 32, a water valve 39, a water-collecting container 40, a gas discharge valve 41, and a weighing device 42.

The axial-pressure zone of the natural gas hydrate formation and dissociation system is located at the leftmost end of reactor 55. Compressed air is introduced into the axial-pressure air chamber 53 using the compressed air pump 51 to push the piston 56 and thereby regulate the pressure of the hydrate zone located at the right side of the axial-pressure zone, such that a porous medium in the hydrate zone is compact. An axial pressure sensor 52 is provided in the axial-pressure air chamber.

The axial-pressure zone is connected via the piston to the left side of a hydrate formation and dissociation zone 67. The hydrate formation and dissociation zone 67 is provided with a piston stop 57 for stopping travel of the piston; the right side of the zone is connected to the liner zone via a separating plate 69 which is control by the separating plate control unit 69. A hydrate zone inlet is provided on the wall of the reactor at the hydrate formation and dissociation zone 67, and configured to realize in-situ hydrate formation and stimulate hydrate exploitation via various methods, such as the depressurized method, the thermal stimulation method, the inhibitor injection method, and a combination thereof. A plurality of temperature sensors are disposed in the hydrate formation and dissociation zone 67 along its axial direction; in the present embodiment, the sensors include left temperature sensor 59, an intermediate temperature sensor 60, and a right temperature sensor 64. The sand-control liner zone 72 is provided with a liner zone inlet 71 which is configured for loading the liner screen meshes and the filling material and thereby enabling the study on the sand control by the liner. The right side of the sand-control liner zone 72 and an exploitation zone is separated by a liner wall, realizing the simulation of actual liner and wellbore wall. A particle size analyzer 78 is provided and configured to realize the real-time inspection of sand production at the exploitation zone. A temperature sensor 73 is provided inside the wellbore exploitation zone. The wellbore exploitation zone is further provided with a wellbore inlet 75 configured for a study on introducing fluid, and a wellbore outlet 77 for simulating the gas/water/sand production. A detachable threaded lid 74 is provided at the right side of the exploitation zone, and configured for cleaning the reactor and introducing substances. All the zones of the natural gas hydrate formation and dissociation system are respectively provided with pressure and temperature sensors for precise monitoring the experimental environment. All the sensors in the system are connected to the sensor data collector 80 and subsequently the data from these sensors are analyzed using the data analyzing software 81.

The gas/water/sand production pipeline 1 is connected to a ball valve 2. One end of the curved pipe is connected to the ball valve 2 and the other end is connected to the detachable upper lid 4. The upper end of the kettle body 20 is connected to the detachable upper lid 4, while its lower end is connected to the detachable lower lid 31. The gas/water/sand mixture flows into the kettle body 20 via the detachable upper lid 4. Circular transparent sight glasses 5 are provided at the upmost position of the outer wall 50 of the kettle body 20 at both left and right sides, wherein a camera 9 and a lamp 6 are provided and configured for observing the gas/water/sand mixture flowing from the detachable upper lid 4. A pre-screening temperature sensor 10 and a pre-screening pressure sensor 11 are disposed below the transparent sight glasses 5, and configured for measuring gas pressure and temperature. Below the detachable upper lid 4 is a chamber and the kettle body 20 with a gradually reducing inner diameter. Along the kettle body with the gradually reducing inner diameter are three filtering layers, (a coarse screening layer, an intermediate screening layer, and a fine screening layer), and each layer is provided with four thin-film pressure sensors. The combination 8, the combination 19, and the combination 25 are respectively placed on these sensors.

The combination 8 comprises a coarse screen mesh 46, pressure measuring sites (force-bearing sites) 44, rings 43 for confining the pressure measuring sites, and an annular support 45. The coarse screen mesh 46 is fixedly attached to the annular support 45. Four pressure sensors, a left thin-film pressure sensor (coarse screening layer) 12, a front thin-film pressure sensor (coarse screening layer) 13; a right thin-film pressure sensor (coarse screening layer) 14, and a rear thin-film pressure sensor (coarse screening layer) 7, are provided below the annular support 45 and configured to measure the weight of the mesh and the produced sands. The combination 19 comprises an intermediate screen mesh 47 and an annular support; the sensors for these layer include a left thin-film pressure sensor (intermediate screening layer) 15, a front thin-film pressure sensor (intermediate screening layer) 16, a rear thin-film pressure sensor (intermediate screening layer) 17, and a right thin-film pressure sensor (intermediate screening layer) 18. The combination 25 comprises a fine screen mesh 48 and an annular support; the sensors for these layer include a left thin-film pressure sensor (fine screening layer) 21, a front thin-film pressure sensor (fine screening layer) 22, a rear thin-film pressure sensor (fine screening layer) 23, and a right thin-film pressure sensor (fine screening layer) 24.

As to the circle 49 formed of the cross section of the inner surface of kettle wall below the pre-screening sensors, its inner diameter reduces gradually. Along the inner surface of the wall of the kettle 20 are three equally spaced planes, wherein four projections for placing the thin-film sensors are disposed at each plane, and passages (through which sensor wires pass) are formed on the kettle body at the corresponding positions. Below the minimum-diameter position, at a position where the inner diameter recovers to the original value, an opening is formed on the kettle wall for placing the sensor 26. The coarse, intermediate, and fine screen meshes, and the corresponding annular supports (wherein the meshes are fixedly attached to the three corresponding annular supports having different sizes), are respectively placed on the thin-film pressure sensors, at the three planes where the inner diameter reduced gradually, for measuring weights of sands of different particle sizes in real time. At the space below the fine screening layer, a post-screening temperature sensor 26 is disposed on the outer wall 50 for measuring the post-screening temperature; a water baffle 28 is disposed below the space. A post-screening pressure sensor 28 is disposed below the higher end of the water baffle 28 and configured to measure post-screening pressure. A degree of clogging of the screen mesh and a degree of airflow stability can be determined by combining the post-screening pressure sensor 27 with the pre-screening pressure sensor 22, and a temperature change of the mixture after passing through the filtering layers can be determined by combining the post-screening temperature sensor 26 with the pre-screening temperature sensor 10. An ultra-fine screen mesh 29 is disposed at a semi-circular opening formed at the lower side of the water baffle 28, and configured to filter out the fine particles remaining in mixture. A gas outlet 30 is provided below the water baffle 28, and connected to a gas recovering unit 38 via a second curved pipe 3 with a gas valve 36 and a gas flowmeter 37. A third curved pipe 3 is provided below the detachable lower lid 31, wherein one end of the pipe is connected to the water outlet 32 and the other end is connected to a water valve 39 and subsequently a water-collecting container 40. The water-collecting container 40 is configured to collect the produced water after the separation, and is weighed by a weighing device 42; the container is provided with a water inlet and a gas outlet, and the gas outlet is provided with a gas discharge valve 41. The kettle and the vibrating unit 34 are fixed on a support 33, so as to produce a vibration for improving sand separation and promoting fluid flow inside the kettle body. The support 33 is configured to secure and support the kettle. A cushion 35 is provided for reducing noise generated by the vibration and protecting the support.

The method of the present invention will be described in detail with FIG. 1 to FIG. 3.

Firstly, the natural gas hydrate formation and dissociation system and the filtering unit are assembled. The natural gas hydrate formation and dissociation system comprises the methane gas pressurizing and introducing unit 62, the water-introducing constant-flow pump 66, the water-bath temperature regulating unit 54, the reactor 55, the particle size analyzer 78, and etc. The filtering unit comprises sand production analysis section, the gas/water/sand production pipeline 1, the kettle body 20, the coarse/intermediate/fine meshes and the corresponding annular supports, the gas outlet pipeline, the water outlet pipeline, the water-collecting container 40 (gas-tight), the vibrating unit 34, the support 33, the cushion 35, and etc.

Under the conditions in compliance with the test requirements, the detachable threaded lid 74 at the right side of the reactor are opened, through which a porous medium is added into the hydrate zone of reactor 55. Then the separating plate 69 is closed by the separating plate control unit 68, and then the first screen mesh, the filling material, and the second screen mesh are loaded into the sand-control liner zone 72. A liner zone temperature sensor 70 is disposed in the sand-control liner zone 72. Then the detachable threaded lid 74 is closed, and a simulative wellbore fluid is introduced through the wellbore inlet 75. After the assembly is complete, all the sensors are connected to the sensor data collector 80. Then the gas-introducing valve 61 at the gas inlet of the hydrate formation and dissociation zone 67 is opened and thereby nitrogen gas is introduced to conduct a leaking detection with soapy water. If, the pressure is stable at a relative higher value for a period of time when the separating plate 69 is closed initially, and then the pressure keeps stable after the separating plate is opened, then there is no leak. The leaking detection ensures the accurate measurement of gas-liquid separation. Then the pre-screening pressure sensor 11, the post-screening pressure sensor 27, the weighing device 42, and the flowmeter 37 will be calibrated, and the thin-film pressure sensors will be zeroed, in order to allow for precise measurement of the sand production, water production and gas production and give accurate sensor data. Then the water-introducing valve 65 and the constant-flow pump 66 of the water inlet of the hydrate zone of the reactor 55, as well as the gas-introducing valve 61 and the methane gas pressurizing and introducing unit 62, are opened for respectively introducing a given amount of liquid or gas. Also, air is introduced at the left side of the reactor into the axial-pressure zone for maintaining the axial-pressure to the axial-pressure air chamber 53, and thereby hydrates are formed. When the pressure in the hydrate zone, measured by the kettle pressure sensor 58, keeps unchanged or reaches a pre-determined value, the system is ready for conducting the simulative exploitation of gas hydrates. Before the simulative process begins, the particle size analyzer 78, the lamp 6, and the camera 9 are turned on, and thereby the sand production can be observer in real time by the particle size analyzer 78 and the camera 9. Then the ball valve 2, the gas discharge valve 41, the gas valve 36, and the water valve 39 are closed, and the pipeline 1 is connected to the ball valve 2. Subsequently, the simulative exploitation process begins by opening the ball valve 2. The exploitation pressure will be monitored by the wellbore pressure sensor 76 and the pre-screening pressure sensor 11. If the simulative exploitation requires a gas-water-sand three-phase separation, the gas valve 36 and the water valve 39 will be opened after the ball valve 2 are opened. If it requires a solid-liquid two-phase separation, the water valve 39 will be opened after the ball valve 2 is opened. If it requires a gas-liquid two-phase separation, the gas valve 36 and the water valve 39 will be opened after the ball valve 2 is opened. If it requires a gas-solid two-phase separation, the vibrating unit 34 and gas valve 36 will be turned on after the ball valve 2 is opened. Sands produced during the hydrate exploitation process will pass through the observation zone, and then the coarse, intermediate, and fine screen meshes where they are separated and weighed by the thin-film pressure sensors. The produced gas and liquid will be respectively measured by the gas flowmeter 37 and the weighing device 42. When a pressure difference between the pre-screening pressure sensor 11 and the post-screening pressure sensor 27 reaches a pre-determined value, it suggests that the screen meshes are clogged, and one solution is to turn on the vibrating unit 34 to promote fluid flow and thereby remove the clogging; alternatively, the vibrating unit 34 may be turned on at regular interval or continuously when the flow of produced water is estimated to be small during the simulative exploitation. The vibrating unit 34 may also be turned on throughout the whole simulative exploitation, except when the thin-film pressure sensors are collecting data.

The data will be analyzed by the data analyzing software 81. Then the ball valve 2, the water valve 39, and the gas valve 36 are closed when the separation and measurement are finished. After the experiment is finished, the annular supports 45 and the ultra-fine screen mesh 29 will be taken out for analyzing the particle sizes of the produced sands. The reactor and the kettle will be cleaned. Thereby, the device enables dynamic monitoring of the produced gas-water-sand mixture during the simulative formation, dissociation, and exploitation of hydrates; the device enables analysis on the changes in parameters such as the gas/water/sand production and the pressure in different stages of an experiment of hydrate exploitation, sand production, and sand control; the device enables analysis on the changes in pressure and the patterns of gas/liquid/solid production in each stage of a simulative exploitation of natural gas hydrates. By adjusting the simulative exploitation protocol, it is possible to obtain feedback in the gas/water/sand production, and thereby evaluate and optimize the sand production and sand control performance, facilitating the analysis and calculation of the varying patterns and features of gas/water/sand production, and providing supports for establishing sand control schemes for actual hydrate exploitations.

In view of the above, a method for separation and measurement in a simulative exploitation of natural gas hydrates, using one of the devices as described above, comprises the following steps:

filling the reactor with a porous medium through one end of the reactor, and closing the separating plate;

checking an gas-tightness of the reactor so as to ensure the sensors to operate normally;

introducing predetermined amounts of water and methane gas sequentially into the hydrate formation and dissociation zone;

introducing air with the compressed air pump to push the piston to maintain a pressure in the hydrate formation and dissociation zone stable;

when the pressure in the hydrate formation and dissociation zone stays unchanged or reaches a predetermined value, the mixture produced during the natural gas hydrate exploitation process enters the kettle body and passes through the plurality of filtering layers, wherein sands will be filtered out and collected, gas will enter the gas recovering unit, and water will enter the water-collecting container; when it is a three-phase separation, turning on the gas recovering unit and the water-collecting container; when it is a solid-liquid separation, turning on the water-collecting container; when it is a gas-liquid separation, turning on the gas recovering unit and the water-collecting container; when it is a gas-solid separation, turning on the vibrating unit and the gas recovering unit.

In this method:

(1) The natural gas hydrate formation and dissociation system and the filtering unit are assembled. The natural gas hydrate formation and dissociation system comprises the gas and water introducing units, the temperature regulating unit, the reactor, the particle size analyzer, and etc. The filtering unit comprises the inlet pipeline, the kettle body, the coarse/intermediate/fine meshes and the corresponding annular supports, the gas outlet pipeline, the water outlet pipeline, the water-collecting container (gas-tight), the vibrating unit, the support, the cushion, and etc.

(2) Under the conditions in compliance with the test requirements, the detachable threaded lid are opened, through which a porous medium is added into the hydrate zone of reactor. Then the separating plate is closed, and then the first screen mesh, the filling material, and the second screen mesh are loaded into the sand-control liner zone. Then the detachable threaded lid is closed, and a simulative wellbore fluid is introduced. After the assembly is complete, all the sensors are connected to the sensor data collector. Then nitrogen gas is introduced through the gas inlet of the hydrate formation and dissociation zone to conduct a leaking detection with soapy water. If, the pressure is stable at a relative higher value for a period of time when the separating plate is closed initially, and then the pressure keeps stable after the separating plate is opened, then there is no leak. The leaking detection ensures the accurate measurement of gas-liquid separation. Then the pre-screening pressure sensor, the post-screening pressure sensor, the weighing device, and the flowmeter will be calibrated, the thin-film pressure sensors will be zeroed, and the lamp and camera will be turned on, in order to allow for precise measurement of the sand production, water production and gas production and give accurate sensor data, and it is possible to inspect the sand production in real time though the particle size analyzer and the camera.

(3) A given amount of liquid and a given amount of gas are introduced through the water and gas inlets of the hydrate zone of the reactor. Also, air is introduced at the left side of the reactor into the axial-pressure zone for maintaining the axial-pressure to the hydrate zone, and thereby hydrates are formed. When the pressure in the hydrate zone keeps unchanged or reaches a pre-determined value, the system is ready for conducting the simulative exploitation of gas hydrates. Before the simulative process begins, the ball valve, the gas discharge valve, the gas valve, and the water valve are closed, and the gas/water/sand production pipeline is connected to the ball valve. Subsequently, the simulative exploitation process begins by opening the ball valve. The exploitation pressure will be monitored by the wellbore pressure sensor and the pre-screening pressure sensor.

(4) If the simulative exploitation requires a gas-water-sand three-phase separation, the gas valve and the water valve will be opened after the ball valve is opened. If it requires a solid-liquid two-phase separation, the water valve will be opened after the ball valve is opened. If it requires a gas-liquid two-phase separation, the gas valve and the water valve will be opened after the ball valve is opened. If it requires a gas-solid two-phase separation, the vibrating unit 34 and gas valve 36 will be turned on after the ball valve is opened.

(5) When a pressure difference between the pre-screening pressure sensor and the post-screening pressure sensor reaches a pre-determined value, it suggests that the screen meshes are clogged, and one solution is to turn on the vibrating unit to promote fluid flow and thereby remove the clogging; alternatively, the vibrating unit may be turned on at regular interval or continuously when the flow of produced water is estimated to be small during the simulative exploitation. The vibrating unit may also be turned on throughout the whole simulative exploitation, except when the thin-film pressure sensors are collecting data.

(6) The data will be analyzed by a software. Then the ball valve, the water valve, and the gas valve are closed when the separation and measurement are finished. After the experiment is finished, the annular supports and the ultra-fine screen mesh will be taken out for analyzing the particle sizes of the produced sands. The reactor and the kettle will be cleaned.

Depending on the needs, the exploitation method can be selected from the depressurization method and the thermal stimulation method, wherein the depressurization method is one of the currently major methods for hydrate exploitation, which involves a dissociation process of hydrate solids to produce methane gas, caused by reducing the pressure on the gas hydrate layer to lower than the phase equilibrium pressure of hydrate under the local temperature. Design of exploitation wells for the depressurization method is similar to those for conventional exploitation of oil and gas; the pressure spreads quickly in the hydrate reservoir with higher permeability, and thus the depressurization method is the most potential method which is economical and effective. The thermal stimulation method refers to a process of heating the gas hydrate layer to raise its temperature to above the equilibrium temperature, which causes the gas hydrate to dissociate into water and natural gas.

The above-mentioned embodiments are only intended to illustrate the technical concept and characteristics of the present invention, enabling those of ordinary skill in the art to understand the content of the present invention and implement them accordingly, but are not intended to limit the scope of the present invention. All equivalent changes or modifications made according to the essence of the present invention should fall within the scope of the present invention.

What is claimed is:

1. A device for separation and measurement in a simulative exploitation of natural gas hydrates, comprising a natural gas hydrate formation and dissociation system and a filtering unit, wherein the natural gas hydrate formation and dissociation system comprises a compressed air pump, a reactor, and a water-bath temperature regulating unit;

a piston and a separating plate is disposed inside an inner chamber of the reactor along an axial direction;

a first confined space between the piston and a first end of the inner chamber is defined to be an axial-pressure air chamber, and the compressed air pump is configured to introduce air into the axial-pressure air chamber to drive the piston towards the separating plate;

a second confined space between the piston and the separating plate is defined to be a hydrate formation and dissociation zone, wherein the hydrate formation and dissociation zone is connected to a methane gas pressurizing and introducing unit and a water-introducing constant-flow pump;

a third confined space between the separating plate and a second end of the inner chamber is defined to comprise a sand-control liner zone and a wellbore exploitation zone;

the axial-pressure air chamber, the hydrate formation and dissociation zone, the sand-control liner zone, the wellbore exploitation zone, and the filtering unit are respectively provided with electronic units for collecting physical properties;

the filtering unit comprises a kettle body, wherein an inlet end of the kettle body is connected to the sand-control liner zone, and an outlet end of the kettle body is connected to a water-collecting container;

a plurality of filtering layers are disposed inside the kettle body from the inlet end to the outlet end, wherein the plurality of filtering layers have successively reduced diameters and successively reduced filtered particle sizes; wherein the plurality of filtering layers comprise a coarse screening layer, an intermediate screening layer, and a fine screening layer, each of the coarse screening layer, the intermediate screening layer, and the fine screening layer comprises an annular support and a screen mesh attached to the annular support, a plurality of pressure measuring sites are defined on the annular support, and each pressure measuring site of the plurality of pressure measuring sites is enclosed by a ring, wherein the ring is configured to confine the each pressure measuring site inside an area of the ring;

a plurality of thin-film pressure sensors relative to the plurality of pressure measuring sites are provided on the kettle body, wherein the plurality of thin-film pressure sensors are configured to measure a total weight of the screen mesh, the annular support, and filtered sands;

a pre-screening pressure sensor and a pre-screening temperature sensor are disposed above the coarse screening layer, and a water baffle is disposed below the fine screening layer, wherein the water baffle is disposed obliquely at an angle inside the kettle body;

a post-screening pressure sensor is disposed below a first side of the water baffle, wherein a degree of clogging and a degree of airflow stability are determined by the post-screening pressure sensor in combination with the pre-screening pressure sensor and the plurality of thin-film pressure sensors;

an ultra-fine screen mesh is disposed at a semi-circular opening formed at a second side of the water baffle, wherein the ultra-fine screen mesh has a filtered particle size lower than a filtered particle size of the fine screening layer, and the second side is lower than the first side;

a post-screening temperature sensor is disposed between the ultra-fine screen mesh and the fine screening layer;

an output end of the plurality of filtering layers is connected to a gas recovering unit, and a sight glass is provided on a wall of the kettle body and above an input end of the plurality of filtering layers;

a camera and a lamp are provided outside the sight glass, wherein the camera is configured to monitor a mixture flowing into the kettle body through the sight glass, and wherein the pre-screening temperature sensor and the post-screening temperature sensor are configured to determine a temperature change of the mixture after passing through the plurality of filtering layers; and a support for securing and supporting the kettle body is disposed at a bottom end of the kettle body, wherein a vibrating unit is provided in the support, and the vibrating unit is configured to produce a vibration for improving a sand separation and promoting a fluid flow inside the kettle body.

2. The device according to claim 1, wherein a detachable upper lid is attached to an upper end of the kettle body, and a detachable lower lid is attached to a lower end of the kettle body.

3. The device according to claim 2, wherein the detachable lower lid has a slope inclined to a water outlet, the water outlet is connected to the water-collecting container via a first pipe, and the first pipe is provided with a water valve;

the water-collecting container is disposed on a weighing device, and the water-collecting container is provided with a gas discharge valve; and the gas recovering unit is connected to a position below the first side of the water baffle via a second pipe, and the second pipe is provided with a gas valve and a gas flowmeter.

4. The device according to claim 1, wherein the axial-pressure air chamber is provided with an axial pressure sensor;

the hydrate formation and dissociation zone is provided with a piston stop, the methane gas pressurizing and introducing unit is provided with a gas-introducing valve, and the water-introducing constant-flow pump is provided with a water-introducing valve;

a plurality of temperature sensors are disposed inside the hydrate formation and dissociation zone and along the axial direction, and a kettle pressure sensor is disposed on an inner surface of the hydrate formation and dissociation zone;

the hydrate formation and dissociation zone is further provided with a hydrate zone inlet;

a first screen mesh, a filling material, and a second screen mesh are sequentially disposed in the sand-control liner zone, and a liner zone temperature sensor is disposed in the sand-control liner zone;

the sand-control liner zone is further provided with a liner zone inlet; and a separating plate control unit is provided and configured to control the separating plate to open or close.

5. The device according to claim 2, wherein a wellbore temperature sensor and a wellbore pressure sensor are disposed in the wellbore exploitation zone;

the wellbore exploitation zone is connected to a particle size analyzer for analyzing particle sizes of produced sands;

a wellbore inlet is provided and configured to introduce a simulative wellbore fluid; and a detachable lid is attached to an end of the reactor at the wellbore exploitation zone.

6. The device according to claim 5, wherein the wellbore exploitation zone is provided with a wellbore outlet, wherein the wellbore outlet is connected to an opening of a detachable upper lid through a sand production analysis section and a ball valve.

7. The device according to claim 1, further comprising a sensor data collector and a host computer, wherein a data analyzing software is installed on the host computer, the sensor data collector is signally connected to sensors in the natural gas hydrate formation and dissociation system and the filtering unit, and configured to collect and analyze data in real time during an experiment.

8. A method for separation and measurement in a simulative exploitation of natural gas hydrates, using the device of claim 1, comprising the following steps:

filling the reactor with a porous medium through an end of the reactor, and closing the separating plate;

checking gas-tightness of the reactor;

introducing predetermined amounts of water and methane gas sequentially into the hydrate formation and dissociation zone, regulating a temperature in the reactor using the water-bath temperature regulating unit, introducing the air with the compressed air pump to push the piston to maintain a pressure in the hydrate formation and dissociation zone stable to form the natural gas hydrates in the hydrate formation and dissociation zone;

when the pressure in the hydrate formation and dissociation zone stays unchanged or reaches a predetermined value, conducting a simulation of a natural gas hydrate exploitation process;

the mixture produced during the natural gas hydrate exploitation process entering the kettle body and passing through the plurality of filtering layers, wherein sands are filtered out and collected, gas enters the gas recovering unit, and water enters the water-collecting container;

when a three-phase separation is performed, turning on the gas recovering unit and the water-collecting container;

when a solid-liquid two-phase separation is performed, turning on the water-collecting container;

when a gas-liquid two-phase separation is performed, turning on the gas recovering unit and the water-collecting container; and when a gas-solid two-phase separation is performed, turning on the vibrating unit and the gas recovering unit.

* * * * *